United States Patent [19]

Wozniacki

[11] 4,272,008

[45] Jun. 9, 1981

[54] STAR DIVIDER

[75] Inventor: Roger M. Wozniacki, Spring, Tex.

[73] Assignee: International Paper Company, New York, N.Y.

[21] Appl. No.: 95,693

[22] Filed: Nov. 19, 1979

[51] Int. Cl.[3] ..... B65D 5/48

[52] U.S. Cl. ..... 229/15; 229/42

[58] Field of Search ..... 229/15, 42

[56] References Cited

U.S. PATENT DOCUMENTS

| | | | |
|---|---|---|---|
| 2,593,092 | 4/1952 | Bergstein | 229/42 |
| 3,199,759 | 8/1965 | Hickin | 229/15 |
| 3,248,036 | 4/1966 | Weiss | 229/15 |
| 3,301,460 | 1/1967 | Harrison | 229/15 |
| 3,384,289 | 5/1968 | Grant | 229/15 |
| 3,682,367 | 8/1972 | Rohde et al. | 229/15 |
| 3,738,561 | 6/1973 | Nederveld | 229/15 |
| 3,756,496 | 9/1973 | Oostdik | 229/15 |
| 3,758,018 | 9/1973 | Black | 229/15 |
| 3,931,924 | 1/1976 | Gardner et al. | 229/42 X |
| 4,130,235 | 12/1978 | Killy | 229/15 |
| 4,144,995 | 3/1979 | Travis | 229/15 |

*Primary Examiner*—Davis T. Moorhead

*Attorney, Agent, or Firm*—Penelope A. Smith

[57] ABSTRACT

A divider is disclosed which may be assembled in several different multicellular configurations. The divider is formed from a one-piece rectangular blank separated into two panels by a central longitudinal slitted-and-scored line. Each panel is further divided into two end segments and four intermediate segments by transverse score lines. The divider is assembled without gluing, and can be used to divide a single carton into five alternate cellular configurations.

1 Claim, 7 Drawing Figures

FIG. 1
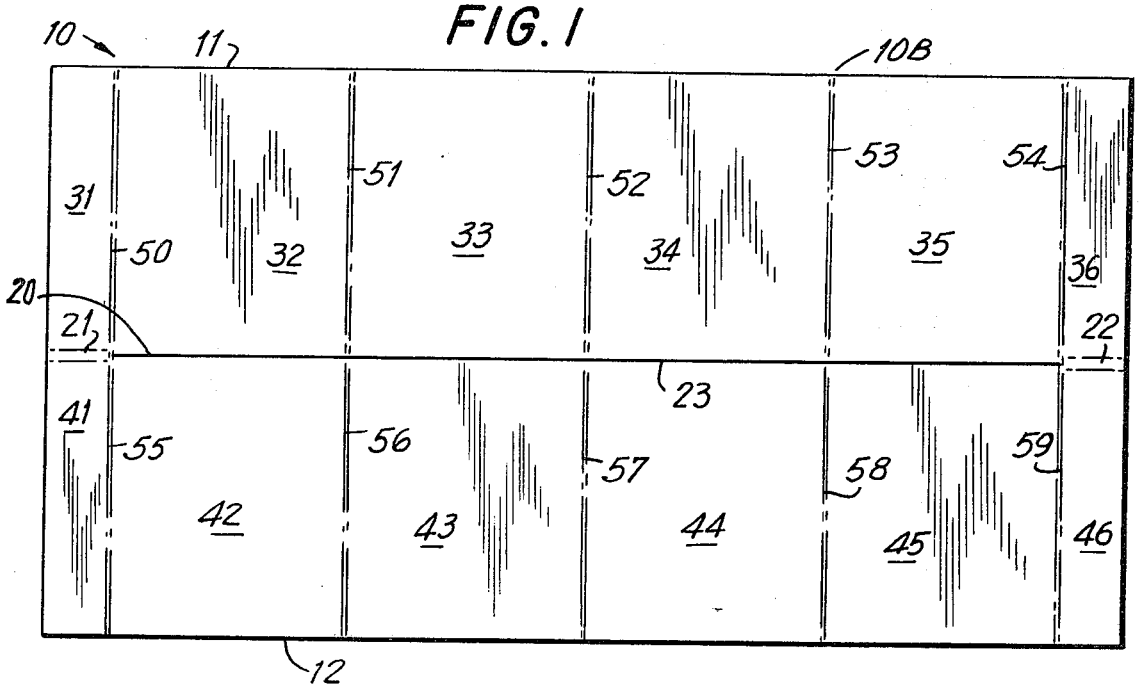
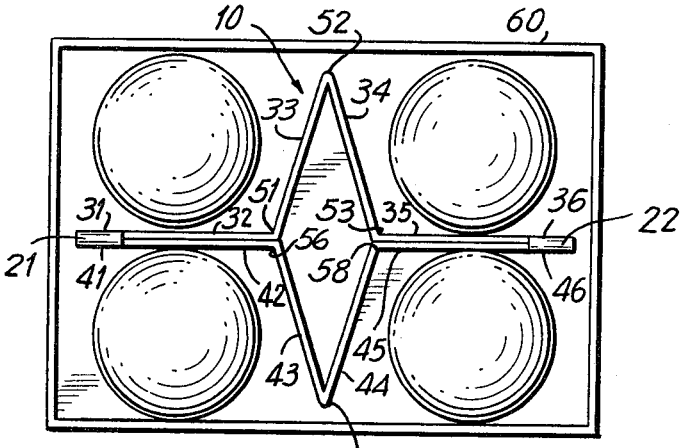
FIG. 3
FIG. 2
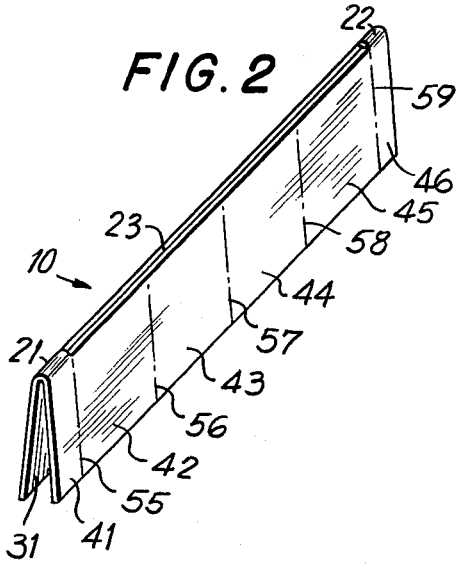
FIG. 4
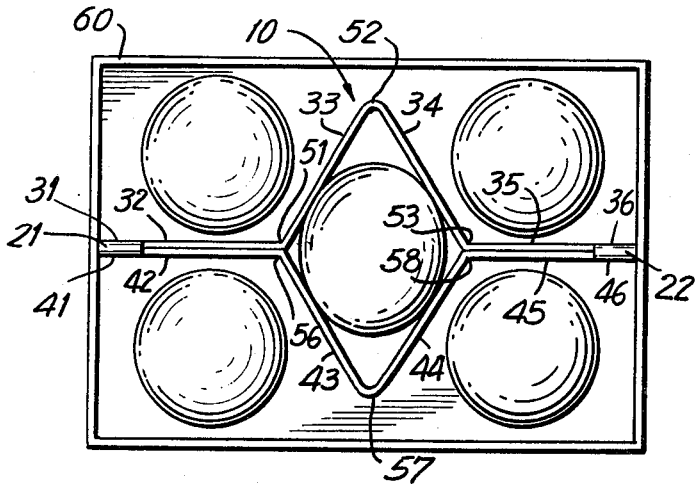

STAR DIVIDER

BACKGROUND OF THE INVENTION

This invention relates to carton dividers, and is particular to a one-piece cushioning divider which may be adjusted to form several different multi-cellular configurations.

Adjustable dividers are used for packing variably sized items, such as fruits and vegetables, which are sold by weight. The produce is generally graded by size before it is packed, and items of like size are packed together. Honeydew melons, for example, are graded into five size ranges. Packing each grade in a separate-sized carton is inefficient and expensive, since it is impossible to predict in advance how many melons will fall into each size range. Since the fruit is perishable, cartons and dividers cannot be manufactured "to order" after the melons are graded. Furthermore, it is desirable to pack about the same weight of melons in each carton. In practice, one or two carton sizes are used, along with a divider which can be adjusted by folding to form the required number of cells. An adjustable divider makes it possible to pack 4 very large, 5 large, 6 medium, 8 small, or 10 very small melons in the same carton using the same divider.

The prior art contains a number of adjustable dividers. However, these dividers are held in shape by a glued seam. Gluing is slower and more difficult to automate than slitting, scoring, or folding. If the glued bond is poor, or the seam is inacurrately placed, the divider may fail in use. Even when the gluing is done properly, this step retards the whole divider-making operation. This is an especially critical problem since the dividers are used to pack perishables with a relatively short harvesting season. At harvest time, dividers must be produced rapidly, accurately, and in very high volumes.

SUMMARY OF THE INVENTION

The divider of this invention is designed to overcome the drawbacks of the adjustable dividers known to the prior art. It is assembled from a rectangular blank, and does not require a gluing step. Depending upon the method of assembly, it may be used to divide a container into 4, 5, 6, or 8 cells, suitable for packing 4, 5, 6, 8, or 10 melons.

The present divider is formed from a rectangular blank which is divided into two panels by a central slitted-and-scored line extending longitudinally across the blank. Each panel is further divided into two end sections and four intermediate sections by five transverse score lines. The end sections of the first panel are connected to the corresponding end sections of the second panel along the scored portions of the central longitudinal line. The intermediate sections of the first panel abut the corresponding intermediate sections of the second panel along the slitted portion of the central longitudinal line. The divider is assembled by simply folding along the central longitudinal line and then exerting inward pressure on opposite ends of the blank to produce further folding along some or all of the transverse score lines. Gluing is not required. Accordingly, the divider of the present invention may be machined and assembled rapidly in large quantities.

BRIEF DESCRIPTION OF THE DRAWINGS

FIG. 1 is a diagrammatic view of the blank from which the divider is formed.

FIG. 2 is a perspective view of the first step in assembling the divider.

FIG. 3 is a perspective view of a rectangular container with the divider placed therein in its first assembled configuration to form four rectangular cells.

FIG. 4 is a perspective view of a rectangular container with the divider placed therein in its second assembled configuration to form five cells.

DESCRIPTION OF THE PREFERRED EMBODIMENTS

Figure 5:
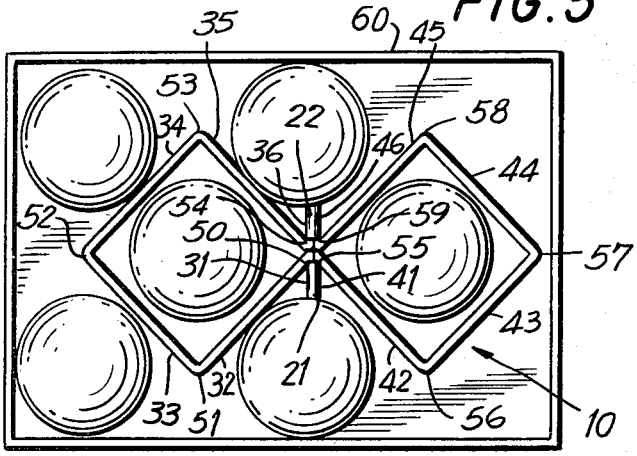
FIG. 5 is a perspective view of a rectangular container with the divider placed therein in its third assembled configuration.

The blank from which the divider is assembled is shown in FIG. 1 of the drawings. The divider is generally denoted by the reference number 10 and the blank by 10B. Blank 10B includes first and second panels, denoted by numbers 11 and 12 respectively, separated by a central longitudinal line generally denoted by 20, with scored portions 21 and 22, and cut portion 23. In the preferred embodiment, portion 23 is a slitted line, but a larged die-cut opening may be made without departing from the spirit of the invention. Scored portions 21 and 22 are preferably double-scored lines.

The first panel 11 is divided into first and second end segments 31 and 36, and first, second, third, and fourth intermediate segments, 32, 33, 34, and 35 by transverse score lines which are double-scored in the preferred embodiment. First intermediate segment 32 is foldably connected to first end segment 31 along transverse score line 50 and to second intermediate segment 33 along transverse score line 51. Third intermediate segment 34 is foldably connected to second intermediate segment 33 along transverse score line 52 and to fourth intermediate segment 35 along transverse score line 53. Fourth intermediate segment 35 is foldably connected to second end segment 36 along transverse score line 54.

The second panel 12 is divided into first and second end segments 41 and 46, and first second, third, and fourth intermediate segments, 42, 43, 44, and 45 by transverse score lines. First intermediate segment 42 is foldably connected to first end segment 41 along transverse score line 55 and to second intermediate segment 43 along transverse score line 56. Third intermediate segment 44 is foldably connected to second intermediate segment 43 along transverse score line 57 and to fourth intermediate segment 45 along transverse score line 58. Fourth intermediate segment 45 is foldably connected to second end segment 46 along transverse score line 59.

The first end segment of the first panel, 31, is foldably connected to the first end segment of the second panel, 41, along longitudinal score line 21. The second end segment of the first panel, 36, is foldably connected to the second end segment of the second panel, 46, along longitudinal score line 22. The intermediate segments of the first panel abut the corresponding intermediate segments of the second panel along longitudinal slit 23. In the preferred embodiment, all of the intermediate segments are substantially equal in size.

The first step in assembling the divider, which is common to all assembled configurations, is shown in FIG. 2. Blank 10B is longitudinally folded along central line 20 so that the first and second panels are brought into face-to-face relation. Assembly of the divider is then completed by exerting inward pressure on the two sets of end segments to produce one of the configurations illustrated in the following figures.

The first of the assembled configurations is illustrated in FIG. 3. Inward pressure is exerted on opposite ends while the first and second end segments and the first and fourth intermediate segments of the first panel are held in face-to-face relation to the corresponding segments of the second panel. Thus the first panel is bent concavely along transverse score lines 51 and 53, and convexly along transverse score line 52, so that its second and third intermediate segments 33 and 34 are brought into face-to-face relation. Similarly, the second panel is bent concavely along transverse score lines 56 and 58, and convexly along transverse score line 57 so that its second and third intermediate segments 43 and 44 are brought into face-to-face relation. A cruciform divider is thereby obtained. This divider may be inserted into a container, generally denoted by reference numeral 60, to form four rectangular cells, as shown in FIG. 3. This configuration is particularly well adapted for packing the largest grade of melons, which are shipped four to a box.

The second assembled configuration is illustrated in FIG. 4. Again, inward pressure is exerted on the ends of the divider, bending the first panel concavely along score lines 51 and 53, and convexly along score line 52, and bending the second panel concavely along score lines 56 and 58, and convexly along score line 57. However, less pressure is exerted in forming this third configuration than was exerted in forming the first configuration, so that a substantially diamond-shaped central cell is formed by segments 33, 34, 43, and 44. The divider is then inserted into the container to form five cells, as shown.

The third assembled configuration is illustrated in FIG. 5. As inward pressure is exerted on the ends of the divider, each panel is allowed to bend along all five transverse score lines. The first panel is bent convexly along score lines 50 and 54, and concavely along score lines 51, 52, and 53 to form a first diamond-shaped cell. The second panel is bent convexly along score lines 55 and 59, and concavely along score lines 56, 57, and 58 to form a second diamond-shaped cell. This configuration is suitable for packing six intermediate-sized melons.

Figure 6:
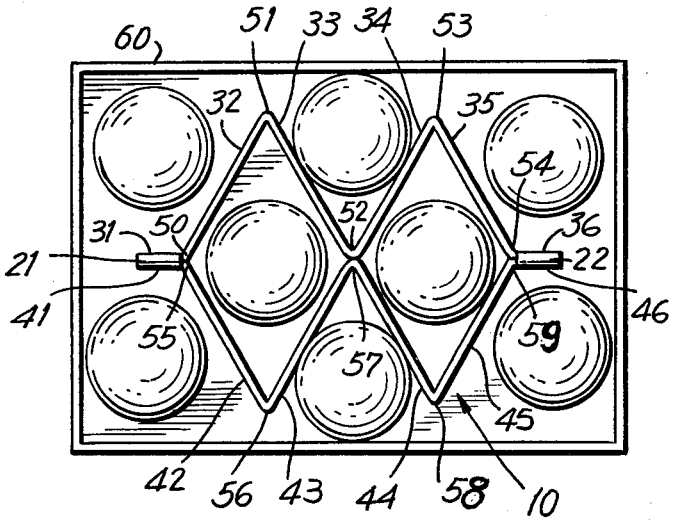
FIG. 6 is a perspective view of a rectangular container with the divider placed therein in its fourth assembled configuration to form eight cells.

The fourth assembled configuration is illustrated in FIG. 6. As inward pressure is exerted on the ends of the divider, the first panel is bent convexly along score lines 50, 52, and 54, and concavely along score lines 51 and 53. At the same time, the second panel is bent concavely along score lines 55, 57, and 59, and concavely along score lines 56 and 58. A first diamond-shaped cell is formed by segments 32, 33, 42, and 43, and a second diamond-shaped cell is formed by segments 34, 35, 44, and 45. When placed in a rectangular box, the divider forms six additional cells so that eight melons may be packed.

Figure 7:
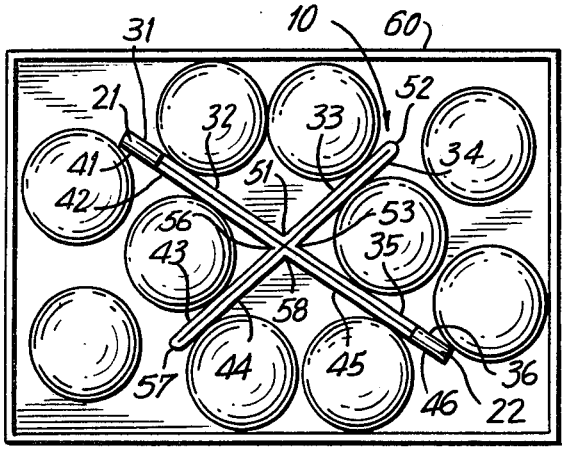
FIG. 7 is a perspective view of a rectangular container with the divider placed therein in its fifth assembled configuration to form four triangular cells.

The cruciform divider of the first assembled configuration is also used to form the fifth assembled configuration, as shown in FIG. 7. The four triangular cells formed by the divider are well-adapted for packing the smallest grade of melons, which are shipped in boxes of ten.

It will be obvious to one skilled in the art that the divider of the present invention may be formed from corrugated paperboard, heavy kraft paper, flexible plastic, and many other materials. In addition to cushioning the articles to be packed, the divider increases the stacking strength of the filled container. This divider will obviously be useful for packing many different articles although it has been described primarily as a melon divider. Modifications will occur to those skilled in the art in view of this disclosure which are nonetheless within the spirit of this invention.

I claim:

1. A unitary blank for an adjustable carton divider consisting of:

a first panel, comprising a first end segment, four intermediate segments, and a second end segment, the segments being foldably connected in series by five transverse score lines; and, a second panel, comprising a first end segment, four intermediatesegments, and a second end segment, the segments being foldably connected in series by five transverse score lines; wherein all of the intermediate segments of the first and second panels are substantially equal in size;

the first end segments of the first and second panels are foldably connected along a first longitudinal score line;

the second end segments of the first and second panels are foldably connected along a second longitudinal score line; and, the intermediate segments of the first panel are in an abutting relation to the intermediate segments of the second panel along a longitudinal slit line.

* * * * *